United States Patent [19]

Stratmann et al.

[11] 4,242,027

[45] Dec. 30, 1980

[54] APPARATUS FOR CHARGING COKE OVEN FURNACES OF A COKE OVEN BATTERY

[75] Inventors: Josef Stratmann, Recklinghausen; Willi Brinkmann, Herne, both of Fed. Rep. of Germany

[73] Assignee: Firma Carl Still, Recklinghausen, Fed. Rep. of Germany

[21] Appl. No.: 8,270

[22] Filed: Feb. 1, 1979

[30] Foreign Application Priority Data

Feb. 4, 1978 [DE] Fed. Rep. of Germany ..... 2804825

[51] Int. Cl.[3] ..... C10B 31/04

[52] U.S. Cl. ..... 414/148; 202/262; 414/163

[58] Field of Search ..... 414/162, 163, 328, 164, 414/786, 271; 202/262, 263

[56] References Cited

U.S. PATENT DOCUMENTS

| | | | |
|---|---|---|---|
| 2,700,479 | 1/1955 | Carlson et al. | 414/271 X |
| 3,880,720 | 4/1975 | Wagener et al. | 414/162 X |
| 4,049,141 | 9/1977 | Rohde et al. | 414/162 X |

*Primary Examiner*—Robert G. Sheridan
*Attorney, Agent, or Firm*—McGlew & Tuttle

[57] ABSTRACT

A coke oven charging device for supplying coal to the charging chutes on the roof of a coke oven battery of a plurality of horizontally arranged coke ovens, comprises a horizontally disposed circulator conveyor supported on the roof at a spaced location thereabove and having a plurality of longitudinal and transversely spaced closable discharge openings. The conveyor is advantageously mounted for some displaceable movement on the roof. In addition, a charging car is movable on the roof over the coke ovens and it includes a closed transfer conveyor mounted on the car which is disposed along the length of the car. The car is advantageously provided with a plurality of coal transfer connections which makes it possible to connect the car and its conveyor to a selected opening of the circulating conveyor and to a selected chute for the transfer of the coal from the circulating conveyor through the car conveyor and into the coke oven battery. With the inventive method, a charging coal is continuously circulated in a path extending over all of the ovens. A moving charging car having a car conveyor is moved over the ovens to a selected location and is connected between the circulating conveyor and a car conveyor and a transfer connection to the charging chute for the delivery of coal from the circulating conveyor to the coke ovens.

9 Claims, 5 Drawing Figures

APPARATUS FOR CHARGING COKE OVEN FURNACES OF A COKE OVEN BATTERY

FIELD AND BACKGROUND OF THE INVENTION

This invention relates to coke ovens in general and, in particular, to a new and useful method and apparatus for charging coke to a plurality of coke ovens which are arranged in a horizontally disposed battery by circulating the coal above the batteries and transferring select quantities thereof into the charging chutes of the batteries by passing it from the circulating conveyor through the car and a conveyor therein and a transfer connection to the charging chute.

DESCRIPTION OF THE PRIOR ART

A device is known from German OS No. 2,239,557 (see U.S. Pat. No. 3,880,720) for charging coke oven chambers arranged in a battery. In this device, the coal is fed by at least one longitudinal conveyor, extending on the battery roof in the direction of the longitudnal axis of the battery, through a charging mechanism in which the conveying surface is a belt which is displaceable in the longitudinal direction and provided with a discharge gate which is equipped with a filling mechanism connectable to the charging ports of the oven chambers.

A particular embodiment of the aforementioned device provides that the conveyor be mounted on the battery roof along one longitudnal side thereof, and that the hopper of the charging mechanism be connected to a transverse feeder spanning the charging holes of an oven chamber and travelling on rails along the longitudinal axis of the battery and designed as a scraper conveyor with vertical fall tubes supporting charging hole connections which are actuable by means of a common lifting and lowering mechanism.

A device for charging oven chambers of a coke oven battery with moist or preheated coal by means of chain conveyors extending along the battery is also known from German OS No. 2,336,515, (see U.S. Pat. No. 3,959,086) which comprises, a 3- to 5-part collecting hopper equipped with 3 to 5 inlet connections which are provided with dust- and gas-tightly closable sliders, with the connections each being equipped with a telescoping ring establishing a dust- and gas-tight connection to the gate of the chain conveyor, and terminating in one or two tubular outlets corresponding to the diameter of the charging hole.

A primarily conventional arrangement in the art is one in which the horizontal conveyor is designed as a feeder or chain conveyor by which the fine coal is received from a coal storage bin and is conveyed through the bottom of its housing directly to the charging chute of the oven chambers to be filled, or to a charging device travelling longitudinally on the battery roof.

With this arrangement, only a limited amount of coal can be taken back over the chain drum of the reversal station or delivered further, namely, a maximum amount would be only about the amount received in the trough or housing section between three oven chamber modular spacings. However, it is more secure and preferable to limit the amount to that received within two such modules. Larger amounts may lead to clogging in the discharge areas at the reversal drum. This does not happen, of course, as long as the charging procedure of the oven chambers remains regular. Such clogging which finally leads to automatic stopping of the plant may occur if the removal of the hot coal already received on the conveyor, with a temperature of about 250° C. is disturbed, particularly if such a disturbance causes a failure in observing the predetermined charging program of the oven chambers. Expenses of a design of the conveying installation which is under inert gas atmosphere ensuring an absence of similar disturbances are not justifiable.

In addition, the transfer of the coal from the transfer gates into the coal charging device is not simple, and the sealing, which is absolutely necessary for environmental reasons, only works satisfactorily if the closing mechanisms are kept absolutely clean. The sliders provided for the sealing, which are permanently loaded with coal must be dustproof and gastight, as mentioned above, since otherwise, coal dust as well as the inert gas would escape from the housing of the horizontal conveyor. For this reason, such sliders are expensive.

In addition, upon detaching the horizontal conveyor from the charging car, residual coal which falls on the roof of the battery cannot be completely avoided and must usually be remedied by troublesome manual labor. Further, with the devices of the prior art, as also mentioned above, five oven chambers at most may be supplied with coal from a single position of the travelling charging device.

Under these circumstances, a reduction of the number of coal transfer openings of the horizontal conveyor or its housing to the charging device would be technologically progressive.

SUMMARY OF THE INVENTION

The present invention is directed to a device for charging coke ovens with coal in such a manner as to avoid any disturbances if the once received coal cannot be removed and the charge program of the oven chambers cannot be met and, in addition, having only a limited number of transfer openings with their complicated sliding closures connecting to the coal charging device, so that expenditures for investment and labor can be reduced.

In accordance with the invention, a horizontally disposed circulator conveyor is arranged in spaced location above the roof of a horizontally disposed coke oven battery and it has means for continuously circulating coal in a closed path above the charging chutes of the battery. In addition, a transfer car is mounted for movement along the battery roof and it is connectable between openings arranged at spaced locations along the circulatory conveyor and selected ones of the charging chutes so that a quantity of coal may be transferred from the circulating conveyor through the charging car to the charging chutes of each battery. For this purpose, the charging car advantageously includes an internal conveyor for shifting the coal between a connection oriented with one of the openings of the circulating conveyor to a transfer connection which is connectable into the charging chute of the coke oven.

With such a design of the horizontal conveyor, it is possible to load it with coal all along its entire longitudinal extension without risking disturbances if, for some reason, no coal is removed therefrom. If coal is removed and transferred to the charging car in accordance with the predetermined program, the free lengths of the endless conveyor are reloaded by the automatically controlled coal tower or coal storage bin and further loading takes place, only afterwards, and at another location, coal is removed from the horizontal conveyor for charging another oven chamber. No problems arise with the conveyed coal in the horizontal deflection areas. The endless conveyor may be constructed in a conventional manner. By providing a plurality of connections to the endless conveyor on the housing of the charging car, the number of the transfer openings with their complicated closing sliders beneath the endless conveyor is substantially reduced and so are the labor expenses for keeping the sliders and the roof clean.

In accordance with the invention, a closed-cycle charging system is provided and the entire charging process is simplified and made reliable.

In order to enlarge the range of action of the charging car, it is advantageous to provide its housing with two coal transfer openings to be connected to the charging chutes of the oven chambers, one on each end, and to make its feeding mechanism reversible, i.e., capable of conveying in both directions.

A preferred embodiment of the invention is one with five connections of the charging car. With coal transfer devices on either side, it is possible to supply ten adjacent oven chambers from a single transfer opening of the horizontal conveyor. However, the number of connections depends substantially on the predetermined program in accordance with which the oven chambers of the battery are charged and discharged so that to carry out the operation in accordance with the "five program" employed in many plants, i.e., the charging and discharging in the order of the numbers 1, 6, 11, 16, etc., it would be sufficient to provide five connections. Ten adjacent oven chambers can be supplied from a single transfer opening in the horizontal conveyor and this is thus considerably more than in the devices of the prior art.

As compared to the complicated dust- and gas-tight closing sliders of the horizontal conveyors, the closing sliders of the housing of the charging car are simple, since the coal only passes therethrough without reposing on the slider blade. In addition, there is no need for an absolute tightness to gas. Simple sliders may be provided at this location and the expenses of four or five of such simple sliders are lower than for a single one of the complicated closing sliders of the transfer openings of the horizontal conveyor. The labor in maintenance and cleaning is also further reduced.

Small leaks of inert gas through the closures of the housing of the charging car may also be tolerated. The inert gas comes with the coal from the horizontal conveyor. A separate inert gas supply of the charging car is unnecessary, but it may be provided in cases of failure.

If predried and preheated coal is to be charged into the oven chambers, a single charging chute is generally sufficient, as is well known, and therefore, usually a single charging car with the respective coal transfer devices is usually sufficient for an endless conveyor provided above the roof of the battery. However, a relatively simple design is one in which the oven chambers can be fed through two charging chutes. While with the provision of a single charging chute for each oven chamber it is sufficient to provide the connections of the horizontal conveyor to the charging car at only one side, e.g., the coke or the pusher side with two charging chutes, they must be provided beneath both sides of the horizontal conveyor, and the charging car must be equipped with two charging devices.

In this design, only one half of the coal supply delivered by the coal tower to the horizontal conveyor is removed on each side, i.e., the pusher side and the coke side, which may easily be done by a corresponding adjustment of the closing sliders of the transfer openings of the horizontal conveyor. With hot coal, an arrangement of the horizontal conveyor close to the oven chamber ends, at the coke or pusher side, is preferred.

The provision of a plurality of charging chutes reduces the known effect of separation of the coal in the oven chamber in addition. In an analogous manner, however, the new device may also be employed for charging moist coal through four charging chutes, for example. In such a case, a separate circulatory conveyor loop in accordance with the invention may be provided for every two adjacent charging chutes or also for the two outer ones and the two inner ones and each associated with a charging car having double charging devices. The circulatory conveyors are preferably designed as chain conveyors.

The conveying mechanisms of the charging cars may also be designed as chain conveyors. The receiving and transfer openings of the charging car are provided with telescoping connections to establish connections with the horizontal circulatory conveyor and the charging chutes of the oven chambers.

Finally, a flow meter is advantageously provided in the charging car below the coal chutes of the conveying mechanisms. In this way, the amount of coal charged into the oven chambers may be measured in a particularly simple manner. As a security measure, two meters may be provided in series at that location. One of the meters is then advantageously designed as a cellular wheel member. Such a closure prevents the gas from penetrating into the charging device.

Accordingly, an object of the invention is to provide an improved method for charging the chutes in the roofs of coke oven furnaces of a horizontally disposed coke oven battery, which comprises, circulating the charging coke in a circulating path extending over all of the ovens, moving a charging car over the ovens to select locations and connecting the charging car to the circulating conveyor for circulating a selected amount from the circulating conveyor through the charging car and into the charging chute.

Another object of the present invention is to provide a coke oven charging device for supplying coal to the charging chutes on the roof of a coke oven battery of a plurality of horizontally arranged coke ovens, which comprises, a horizontally disposed circulatory conveyor, with support means for supporting the conveyor at a spaced location above the coke oven battery and, wherein, the circulator has a plurality of longitudinally and transversely spaced closable discharge openings which are alignable with a filling connection of a charging car which moves over the roof and has a closed transfer conveyor mounted thereon, the charging car also including a coal transfer connection to the charging chutes so that coal may be periodically removed from the circulating conveyor to the charging car and then directed into the coke ovens.

A further object of the invention is to provide a coke oven charging device for supplying coal to the charging chutes of a plurality of coke ovens which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
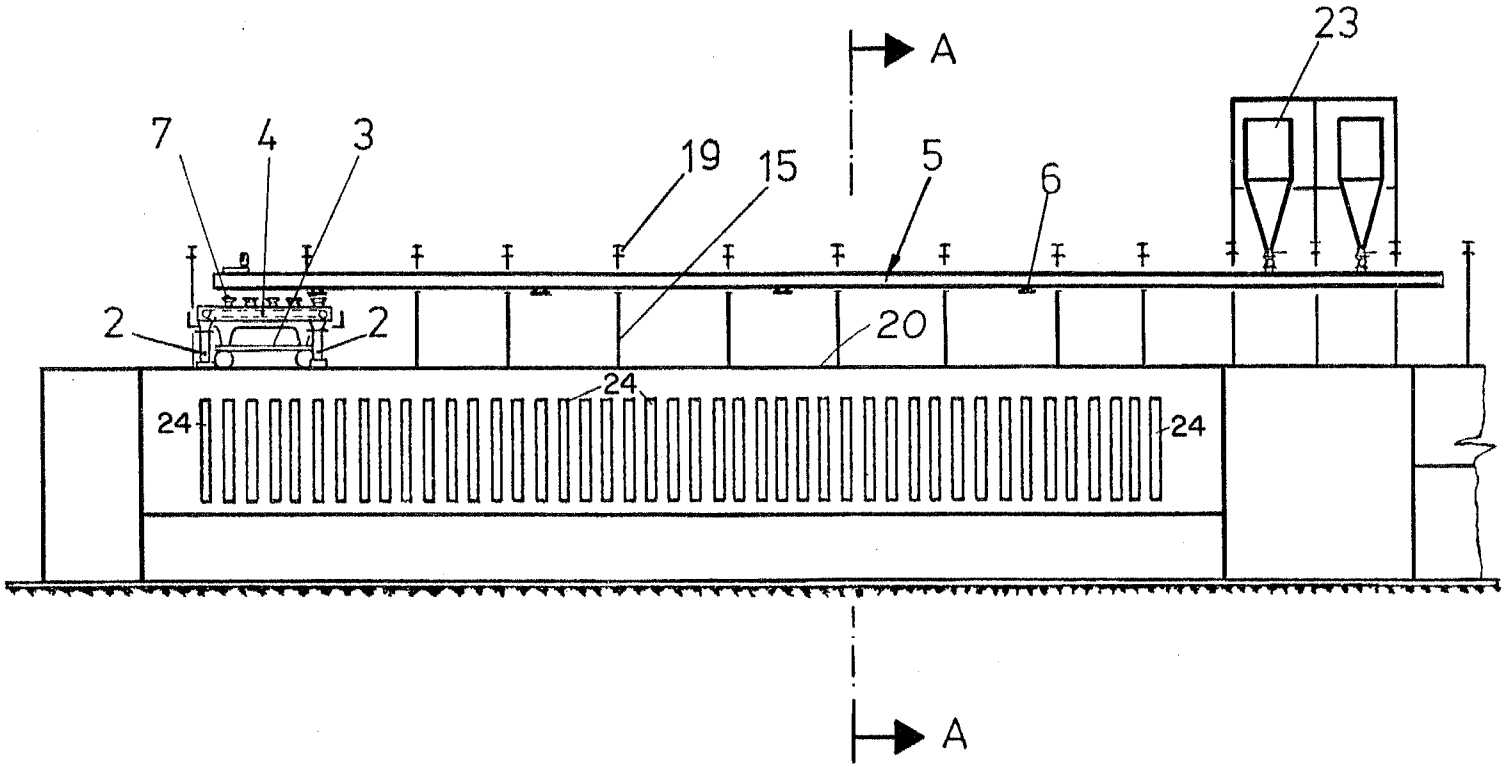
FIG. 1 is a partial side elevational view of a coke oven battery having a charging device constructed in accordance with the invention.
Figure 2:
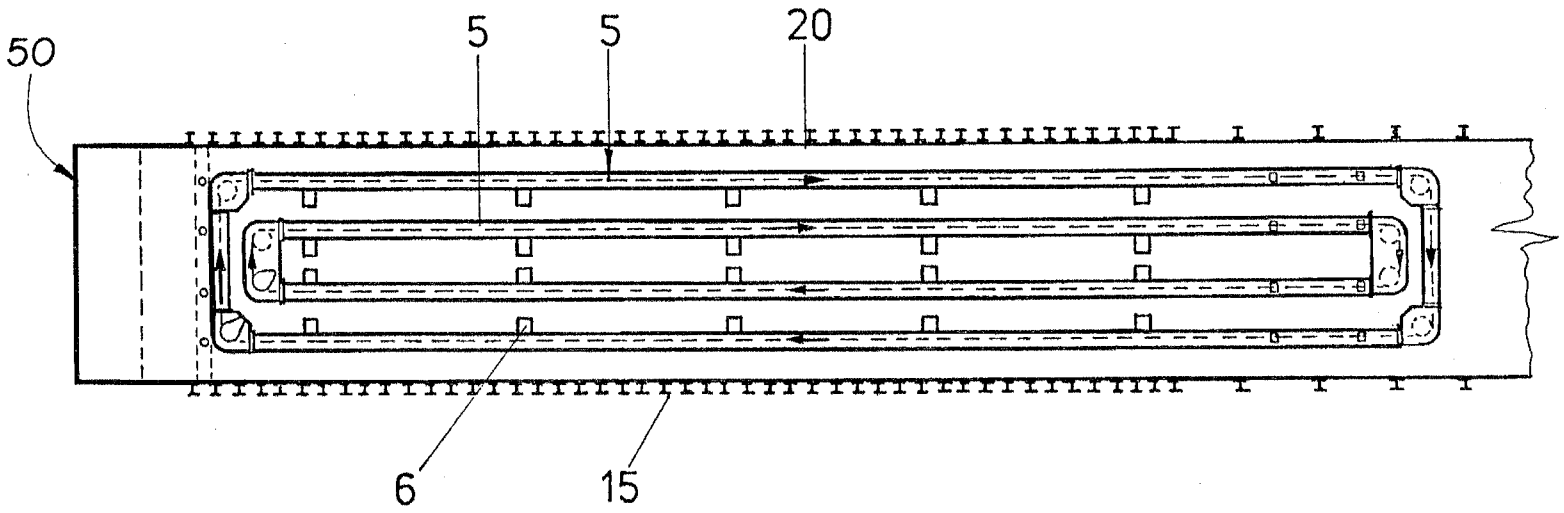
FIG. 2 is a top plan view of the coke oven shown in FIG. 1.
Figure 3:
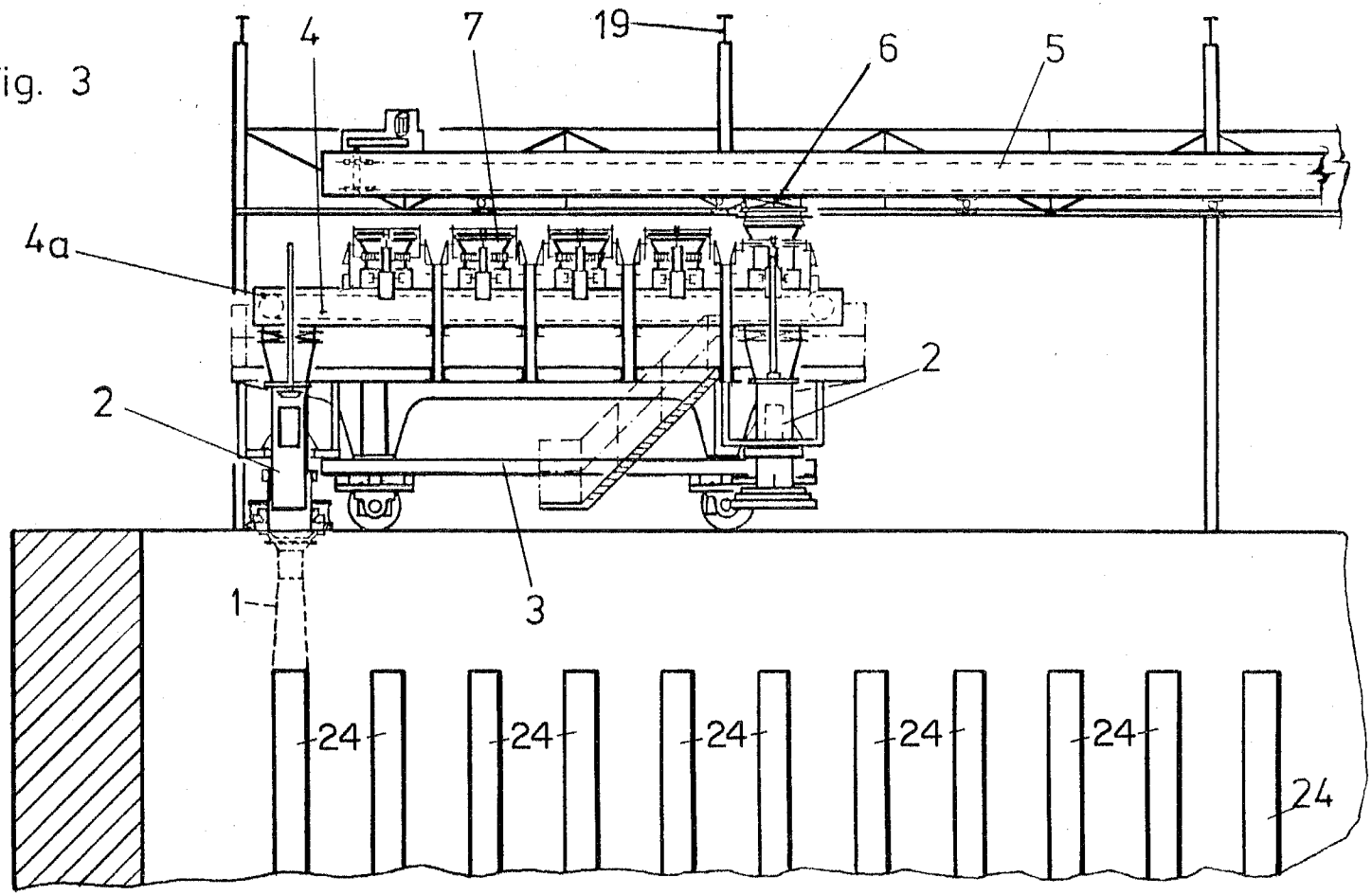
FIG. 3 is an enlarged side elevational view, partly in section, showing the connection of the charging car to both the circulator and a single coke oven charging chute.
Figure 4:
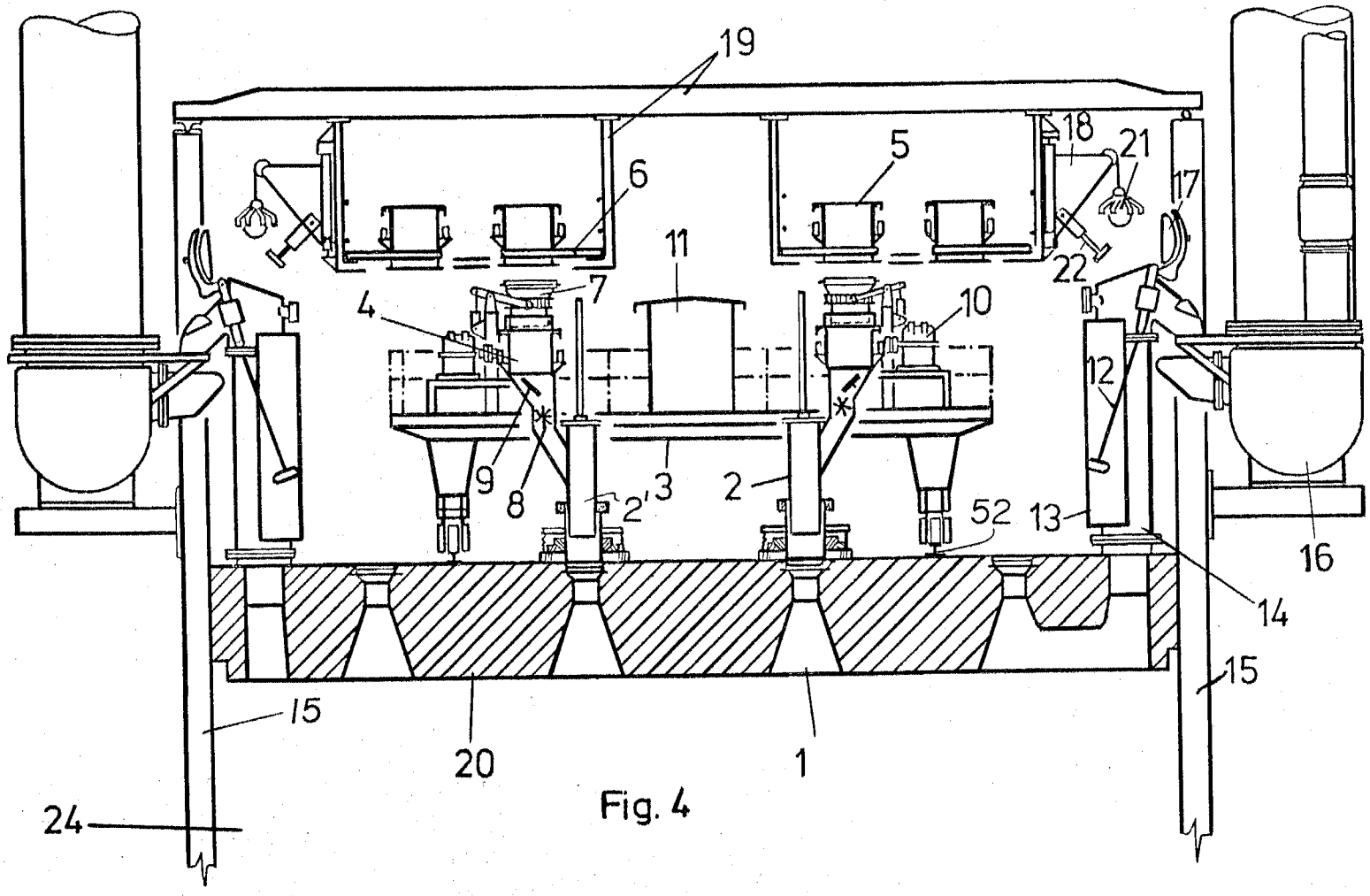
FIG. 4 is an enlarged transverse sectional view of the coke oven shown in FIG. 1 taken along view line A—A showing the connection of the charging car to two separate charging chutes.

Referring to the drawings in particular, the invention embodied therein, comprises, a coke oven charging device for supplying coal to charging chutes 1 extending through a roof 20 to each coke oven chamber 24 of a coke oven battery, generally designated 50, which comprises a plurality of coke oven chamber 24 successively arranged in a horizontal row along the longitudinal axis of the battery. In accordance with the invention, a horizontally disposed circulator, generally designated 5, is mounted on a support structure 19 which, in turn, is mounted for movement along side support posts 15, 15 on each side. (See FIG. 4). The circulator 5 is arranged above the oven battery, vertically spaced above a roof 20 having charging chutes 1 which enter into the various coking chambers 24. The circulator conveyor 5 has a plurality of longitudinally and transversely spaced closable discharge openings 6 which may be selectively aligned with one or more transfer openings or connections 7 of the charge car 3 which is movable along a trackway 52 on the roof 20. Charge car 3 having a housing 24A contains the charge car conveyor 4 which extends longitudinally of the car, as shown in FIGS. 1 and 4, for the purpose of transferring coal which is received through the coal transfer opening 7 to a selected one of a plurality of downwardly extending filling hoppers 2, 2', etc. The filling hoppers 2 are selectively aligned in a charging chute 1 and they also include means for opening the tops of chutes 1 for charging purposes.

In accordance with the method of the invention, coal may be delivered, for example, from coal storage bins 23 into the circulating conveyor 5 where it is continuously circulated until it is used. In the embodiment shown, the circulator 5 comprises a closed pneumatic tube for the circulation of the coal but it may comprise any other type of conveyor, such as a scraper conveyor, which is advantageously arranged in a closed circulating passageway so as not to pollute the atmosphere.

Figure 5:
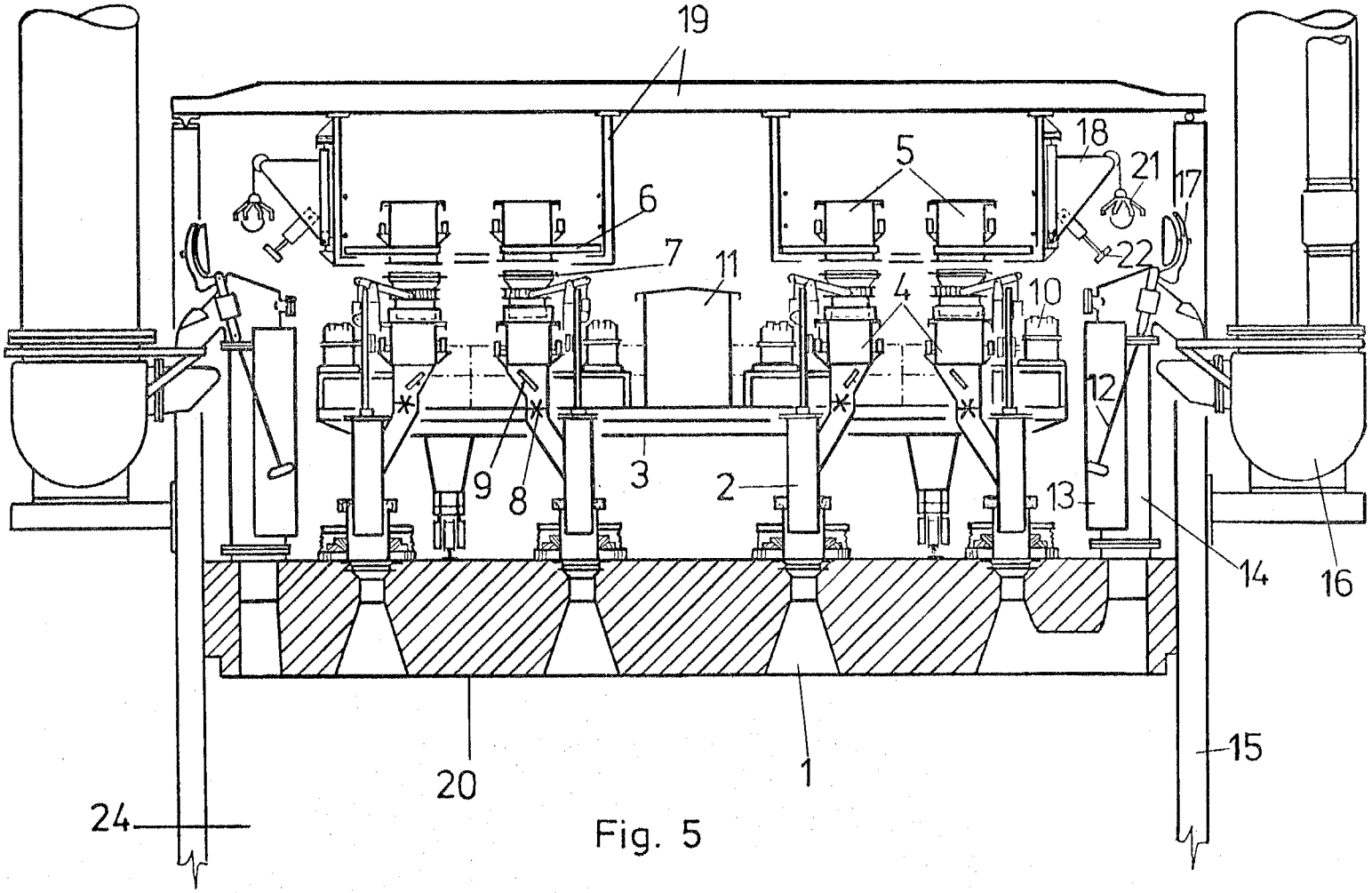
FIG. 5 is a view similar to FIG. 4 of another embodiment of the invention.

As shown in FIGS. 4 and 5, coal which is delivered along the conveyor 4 of the charge car 3 is dropped downwardly through a chute having a flow meter 9 and is moved past a cellular wheel closure feeding device 8 into the filling hopper 2. The charging car 3 has a drive 10 which moves the car along the trackway 52 and may also be connected to regulate the movement of the conveyor 4 which may advantageously be reversibly operated to convey coal in both directions.

The control station 11 for controlling the operation of the car is provided centrally thereof. A raiser tube 14 is arranged on each side of the coke oven furnace having a shield 13 and it is closed on its top by a cover 17 which may be raised and lowered by an actuating lever 12. A device for cleaning the raiser on the charging car is located at 18. Cleaning bomb 21 and a cleaning cutter 22 is also provided at the same location. A collecting main 16 is located on each side of the coke oven.

While specific embodiments of the invention have been shown and described in detail to illustrate the application of the principles of the invention, it will be understood that the invention may be embodied otherwise without departing from such principles.

What is claimed is:

1. In combination, an improved coke oven charging device, for supplying coal to a plurality of charging chutes extending through a roof to each coke oven chamber of a battery of coke oven chambers successively arranged along a longitudinal horizontal axis of the battery, of the type having a circulator conveyor horizontally disposed in a spaced location above the roof and a coal charging car movable along the roof with means for transfering coal between the circulator conveyor and the charging chutes, the improvement wherein the circulator conveyor comprises an endless conveyor having a plurality of longitudinally and transversely spaced discharge openings, and the coal charging car comprises a housing, a transfer conveyor mounted to said housing along at least a part of the length thereof along the longitudinal axis of the battery, said housing having a plurality of coal transfer opening connections selectively connectable to said circulator conveyor discharge openings for receiving coal therefrom and for delivering the coal to said transfer conveyor and at least one filling connection with one end connected to said transfer conveyor and a second end connectable to a selected charging chute.

2. An improved coke oven charging device, as claimed in claim 1, wherein said at least one filling connection comprises a plurality of coal filling connections, said coal filling connections being disposed at opposite ends of said charge car, and said transfer conveyor being operative to convey coal to said coal filling connections at said opposite ends.

3. An improved coke oven charging device, as claimed in claim 1, wherein said charging car has a plurality of transfer connections thereon up to five in number which are connectable to said circulator conveyor.

4. An improved coke oven charging device, as claimed in claim 1 wherein said circulator conveyor includes two endless conveyor portions, each associated with a single charging car, said charging car serving at least four charging chutes.

5. An improved coke oven charging device, as claimed in claim 1 wherein said circulator conveyor comprises a chain conveyor.

6. An improved coke oven charging device as claimed in claim 1, wherein said charging car transfer conveyor comprises a chain conveyor.

7. An improved coke oven charging device, as claimed in claim 1, including means associated with said coal filling connection for measuring the flow amount of the coal therethrough.

8. An improved coke oven charging device, as claimed in claim 7, including a cellular wheel closure feeding device.

9. An improved coke oven charging device, as claimed in claim 1, wherein said filling connection comprising a plurality of filling hoppers, one of said filling hoppers being disposed at each end of said transfer conveyor, and said transfer conveyor being reversibly operative to convey coal to each of said filling hoppers.

* * * * *